US009638187B2

(12) United States Patent
Saito et al.

(10) Patent No.: US 9,638,187 B2
(45) Date of Patent: May 2, 2017

(54) PUMP DEVICE AND SHIP PROPULSION MACHINE

(71) Applicant: Showa Corporation, Gyoda-shi (JP)

(72) Inventors: Takahiko Saito, Haga-gun (JP); Atsushi Kagawa, Haga-gun (JP); Hayato Tsutsui, Haga-gun (JP)

(73) Assignee: SHOWA CORPORATION, Gyoda-Shi (JP)

( * ) Notice: Subject to any disclaimer, the term of this patent is extended or adjusted under 35 U.S.C. 154(b) by 0 days.

(21) Appl. No.: 14/866,427

(22) Filed: Sep. 25, 2015

(65) Prior Publication Data

US 2016/0265358 A1 Sep. 15, 2016

(30) Foreign Application Priority Data

Mar. 12, 2015 (JP) ..... 2015-049718

(51) Int. Cl.

| | |
|---|---|
| ***F01C 17/00*** | (2006.01) |
| ***F04C 11/00*** | (2006.01) |
| ***B63H 20/08*** | (2006.01) |
| ***F04C 2/18*** | (2006.01) |
| ***F04C 15/00*** | (2006.01) |

(52) U.S. Cl.

CPC ..... *F04C 11/003* (2013.01); *B63H 20/08* (2013.01); *F01C 17/00* (2013.01); *F04C 2/18* (2013.01); *F04C 11/006* (2013.01); *F04C 15/0046* (2013.01); *F04C 15/0049* (2013.01); *F04C 2270/13* (2013.01)

(58) Field of Classification Search

CPC . B63H 5/125; F04C 15/00; F04C 2/00; F04C 2/08; F04C 2/16; F01C 1/18; F01C 17/00; F04B 17/00; F04B 21/00

USPC ..... 440/53; 418/83, 104, 126, 135, 206.5, 418/206.6, 206.7, 204

See application file for complete search history.

(56) References Cited

U.S. PATENT DOCUMENTS

| | | | | |
|---|---|---|---|---|
| 6,991,442 | B2 * | 1/2006 | Meguro | F04C 2/18 418/206.4 |
| 8,684,473 | B2 * | 4/2014 | Nakazawa | F04C 2/18 418/206.5 |

FOREIGN PATENT DOCUMENTS

JP 2010-038015 A 2/2010

OTHER PUBLICATIONS

U.S. Appl. No. 14/866,039, Saito et al.

* cited by examiner

*Primary Examiner* — Lars A Olson
(74) *Attorney, Agent, or Firm* — Leason Ellis LLP

(57) ABSTRACT

A pump device includes a shaft, a first gear pair, a second gear pair, a support pin, and a casing. The first gear pair includes a first driving gear which is disposed on the shaft and is rotatable together with the shaft, and a first driven gear driven by the first driving gear. The second gear pair includes a second driving gear which is disposed on the shaft coaxially with the first driving gear and is rotatable together with the shaft, and a second driven gear driven by the second driving gear and arranged coaxially with the first driven gear. The support pin penetrates the first driven gear and the second driven gear and rotatably supporting the first driven gear and the second driven gear. The casing covers the first gear pair and the second gear pair. The support pin is fitted to the casing to be fixed.

18 Claims, 11 Drawing Sheets

PUMP DEVICE AND SHIP PROPULSION MACHINE

CROSS-REFERENCE TO RELATED APPLICATIONS

This application claims the benefit of Japanese Patent Application JP 2015-049718, filed Mar. 12, 2015, the entire content of which is hereby incorporated by reference, the same as if set forth at length.

BACKGROUND OF THE INVENTION

1. Field of the Invention

The present invention relates to a pump device and a ship propulsion machine.

2. Description of Related Art

Recently, a technique of adjusting a tilt/trim angle of an outboard motor by a pump device is proposed.

For example, a pump device described in JP-A-2010-038015 (Patent Document 1) is a gear pump which includes a pump case forming an outer shell and a pair of pump gears fitted to a pump chamber formed inside the pump case and are engaged with each other so as to be respectively rotatable around axes parallel to each other.

SUMMARY OF THE INVENTION

The pump device may include plural pumps thereinside. In this structure, an assembly work is more difficult as compared with, for example, a structure having one pump.

An object of the present invention is to facilitate the assembly work of the pump device having plural pumps and the like.

According to an embodiment of the present invention, there is provided a pump device including a shaft, a first gear pair including a first driving gear which is disposed on the shaft and is rotatable together with the shaft, and a first driven gear driven by the first driving gear to feed an operating fluid, a second gear pair including a second driving gear which is disposed on the shaft coaxially with the first driving gear and is rotatable together with the shaft, and a second driven gear driven by the second driving gear and arranged coaxially with the first driven gear to feed an operating fluid, a support pin penetrating the first driven gear and the second driven gear and rotatably supporting the first driven gear and the second driven gear and a casing covering the first gear pair and the second gear pair, in which the support pin is fitted to the casing to be fixed.

Here, the casing may have plural casings housing the first gear pair and the second gear pair by sandwiching the first gear pair and the second gear pair, and the support pin may be fitted to the plural casings to be fixed.

The plural casings may include a first casing, a second casing and a third casing, the first gear pair may be housed by being sandwiched between the first casing and the second casing, the second gear pair may be housed by being sandwiched between the second casing and the third casing, and both ends of the support pin may be fitted to the first casing and the third casing respectively to be fixed.

Each of the first driven gear and the second driven gear has an insertion hole into which the support pin is inserted, and at least one of the first driven gear and the second driven gear may have, around the insertion hole, a groove continued to the insertion hole.

The first driving gear, the first driven gear, the second driving gear and the second driven gear may have the same number of teeth.

According to another aspect of the present invention, there is provided a pump device including a shaft, a first gear pair including a first driving gear which is disposed on the shaft and is rotatable together with the shaft, and a first driven gear driven by the first driving gear and having the same number of teeth as the first driving gear to feed an operating fluid, a second gear pair including a second driving gear which is disposed on the shaft coaxially with the first driving gear, is rotatable together with the shaft and has the same number of teeth as the first driving gear, and a second driven gear driven by the second driving gear, arranged coaxially with the first driven gear and having the same number of teeth as the first driving gear to feed an operating fluid, a support pin having a smaller diameter than the shaft, penetrating the first driven gear and the second driven gear and rotatably supporting the first driven gear and the second driven gear and a casing including plural casings which house the first gear pair and the second gear pair by sandwiching the gear pairs, in which the support pin is fitted to the plural casings to be fixed.

The plural casings may include a first casing, a second casing and a third casing, the first gear pair may be housed by being sandwiched between the first casing and the second casing, the second gear pair may be housed by being sandwiched between the second casing and the third casing, and both ends of the support pin may be fitted to the first casing and the third casing respectively to be fixed.

According to further another aspect of the present invention, there is provided a ship propulsion machine including a ship propulsion machine body having a propeller, and a tilt/trim device including a cylinder device having a cylinder, a piston partitioning an inside of the cylinder into a first chamber and a second chamber and a piston rod an end portion of which is fixed to the piston and which is extended from the cylinder and a pump device configured to extend and retract the cylinder device by supplying an operating fluid into the cylinder device, in which the pump device includes a shaft, a first gear pair including a first driving gear which is disposed on the shaft and is rotatable together with the shaft, and a first driven gear driven by the first driving gear to feed an operating fluid, a second gear pair including a second driving gear which is disposed on the shaft coaxially with the first driving gear and is rotatable together with the shaft, and a second driven gear driven by the second driving gear and arranged coaxially with the first driven gear to feed an operating fluid, a support pin penetrating the first driven gear and the second driven gear and rotatably supporting the first driven gear and the second driven gear, and a casing covering the first gear pair and the second gear pair, in which the support pin is fitted to the casing to be fixed.

According to the present invention, the assembly work of the pump device having plural pumps can be facilitated.

DESCRIPTION OF EMBODIMENT

Hereinafter, an embodiment of the present invention will be explained in detail with reference to the attached drawings.

Figure 1:
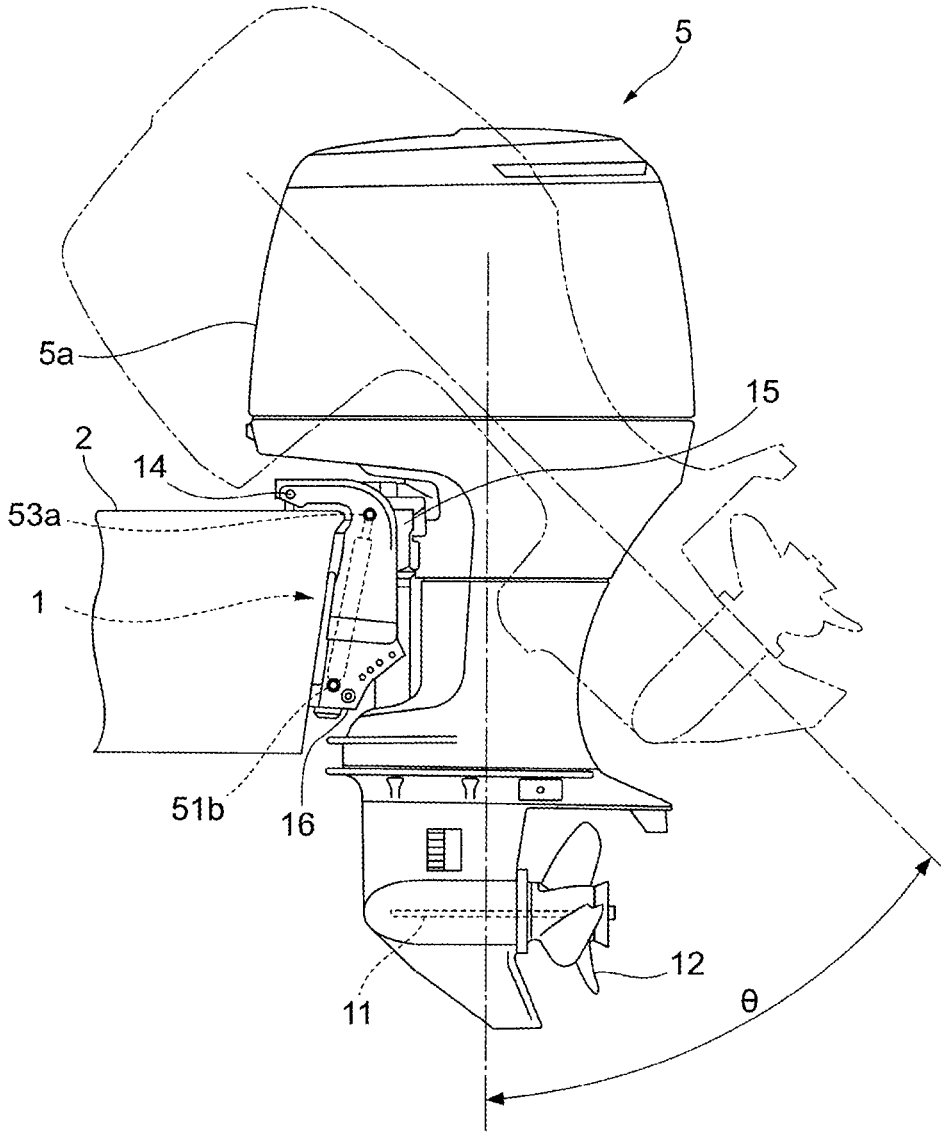
FIG. 1 is a schematic structure view of an outboard motor to which a tilt/trim device according to an embodiment of the present invention is applied.

FIG. 1 is a schematic structure view of an outboard motor 5 to which a tilt/trim device 1 according to an embodiment of the present invention is applied.

The outboard motor 5 as an example of a ship propulsion machine includes an outboard motor body 5*a* generating a propulsive force with respect to a ship body 2 of a ship and the tilt/trim device 1 adjusting a tilt angle θ of the outboard motor body 5*a* with respect to the ship body 2.

(Schematic Structure of Outboard Motor Body 5*a*)

The outboard motor body 5*a* as an example of a ship propulsion machine body includes an engine (not shown) placed so that an axial direction of a crank shaft (not shown) is directed to a perpendicular direction (upper and lower direction in FIG. 1) with respect to the water surface and a drive shaft (not shown) rotatably integrally connected at a lower end of the crank shaft and extending in the vertical direction. The outboard motor body 5*a* includes a propeller shaft 11 connected to the drive shaft through a bevel gear mechanism and a propeller 12 attached to a rear end of the propeller shaft 11.

The outboard motor body 5*a* includes a swivel shaft (not shown) provided in the perpendicular direction (upper and lower direction in FIG. 1) with respect to the water surface, a horizontal shaft 14 provided in the horizontal direction with respect to the water surface and a swivel case 15 in which the swivel shaft is rotatably housed. The swivel case 15 is connected to a pin hole 53*a* of a piston rod 53 of a later-described cylinder device 50 of the tilt/trim device 1 by a pin (not shown).

(Schematic Configuration of Tilt/Trim Device 1)

Figure 2:
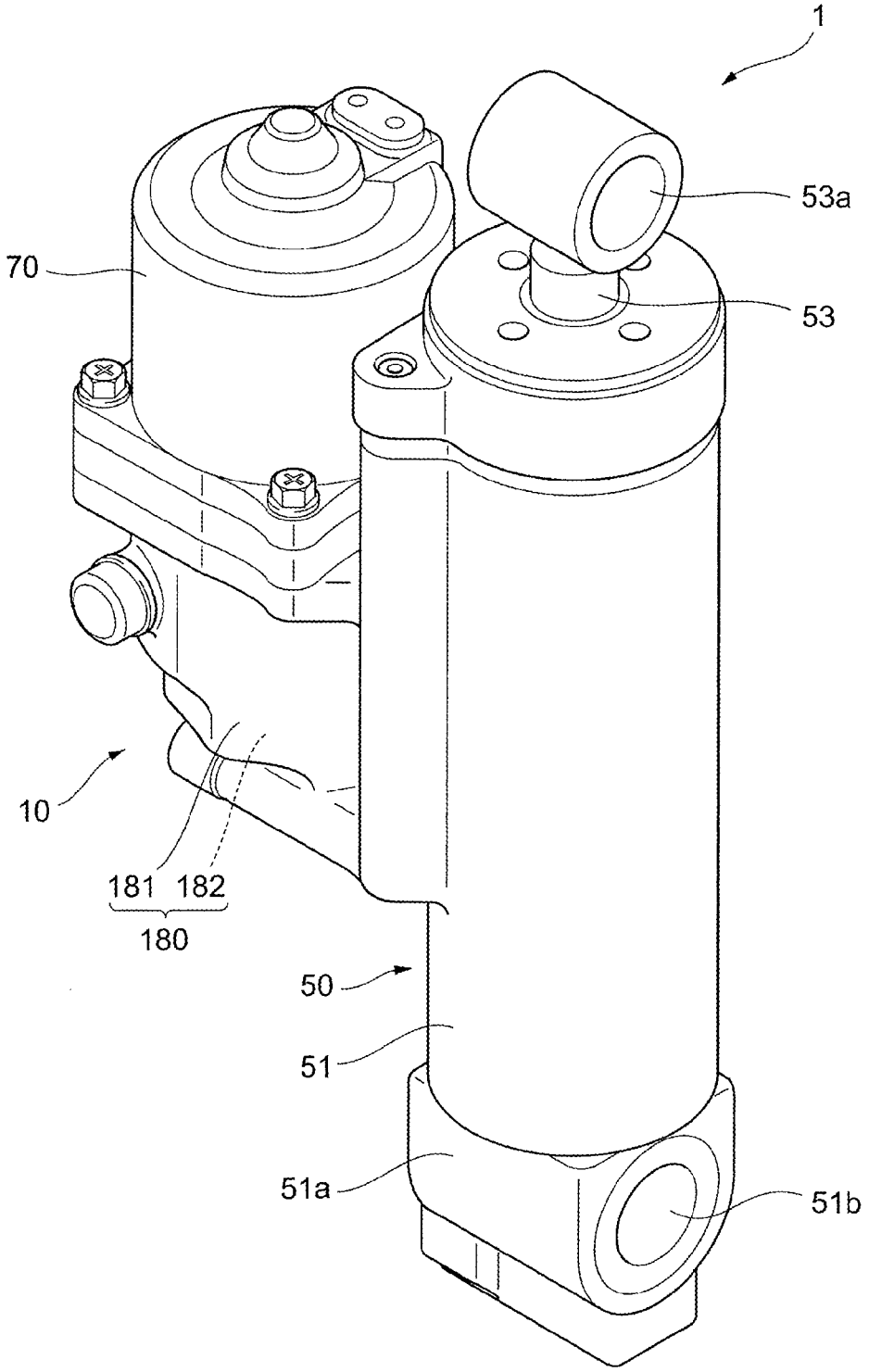
FIG. 2 is an outside view of a tilt/trim device.

FIG. 2 is an outside view of the tilt/trim device 1.

Figure 3:
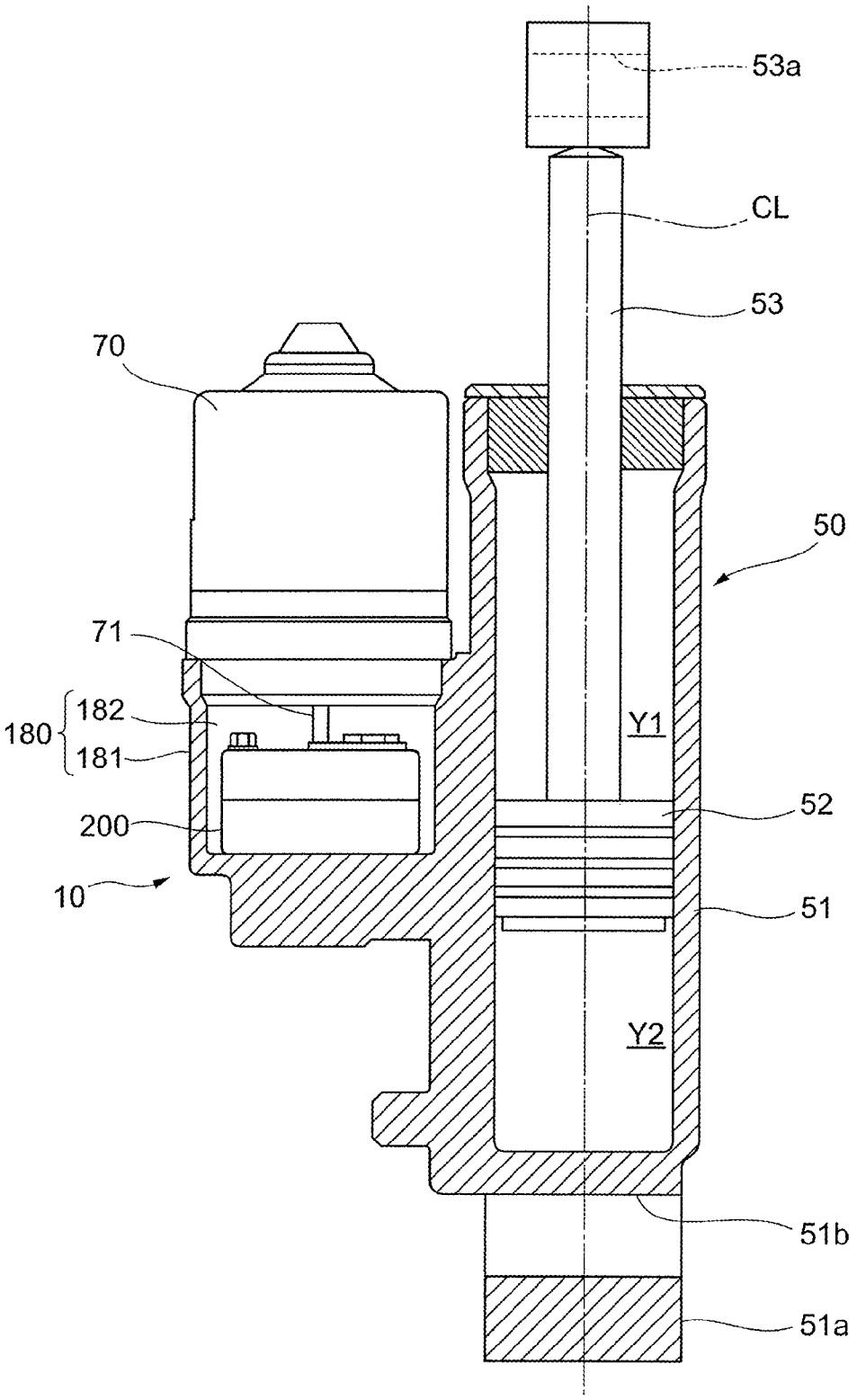
FIG. 3 is a partial cross-sectional view of the tilt/trim device.

FIG. 3 is a partial cross-sectional view of the tilt/trim device 1.

The tilt/trim device 1 includes a cylinder device 50 extending and retracting by supplying and discharging oil, a pump device 10 discharging the oil and a motor 70 driving the pump device 10 as shown in FIG. 2 and FIG. 3.

The tilt/trim device 1 also includes a stern bracket 16 (see FIG. 1) connecting the swivel case 15 of the outboard motor body 5*a* to the ship body 2. The stern bracket 16 is connected to a pin hole 51*b* of a later-described cylinder 51 by a pin (not shown).

(Cylinder Device 50)

The cylinder device 50 includes the cylinder 51 extending in a shaft center CL direction and a piston 52 arranged inside the cylinder 51 and partitioning an internal space of the cylinder 51 into a first chamber Y1 and a second chamber Y2. The cylinder device 50 includes a piston rod 53 holding the piston 52 at an end portion in the shaft center CL direction and moving in the shaft center CL direction with respect to the cylinder 51 with the piston 52.

In the following description, a middle lower direction in FIG. 3 may be referred to as a "lower direction" and a middle upper direction in FIG. 3 may be referred to as an "upper direction" when indicating the direction of the cylinder 51 in the shaft center CL direction.

The cylinder device 50 retracts when the oil is supplied to the first chamber Y1 and extends when the oil is supplied to the second chamber Y2. The cylinder device 50 discharges the oil from the first chamber Y1 when extending and discharges the oil from the second chamber Y2 when retracting.

The cylinder device 50 includes a projection 51*a* in a lower part of the cylinder 51, and a pin hole 51*b* into which the pin (not shown) for connecting to the stern bracket 16 (see FIG. 1) of the outboard motor body 5*a* is inserted is formed in the projection 51*a*. In an upper end of the piston rod 53, a pin hole 53*a* into which the pin (not shown) for connecting to the swivel case 15 (see FIG. 1) of the outboard motor body 5*a* is inserted is formed.

When the cylinder device 50 extends and retracts in a state where the cylinder device 50 is connected to the stern bracket 16 through the pin hole 51*b* formed in the lower part of the cylinder 51 and the cylinder device 50 is connected to the swivel case 15 through the pin hole 53*a* formed in the piston rod 53, the distance between the stern bracket 16 and the swivel case 15 is changed. When the distance between the stern bracket 16 and the swivel case 15 is changed, a tilt angle θ of the outboard motor body 5*a* of the ship body 2 is changed.

(Pump Device 10)

The pump device 10 includes a tank 180 reserving the oil and a pump 200 arranged in the tank 180 and discharging the oil reserved in the tank 180.

(Tank 180)

The tank 180 includes a housing 181 and a tank chamber 182 as a space surrounded by the housing 181 and the motor 70 as shown in FIG. 3.

The housing 181 in the shown example has a bottomed cylindrical shape opening upward, which is integrally formed with the cylinder 51 of the cylinder device 50. Holes (not shown) forming a later described first flow path 111 and a second flow path 112 are formed between the cylinder 51 and the housing 181.

The motor 70 is fixed above the housing 181 so as to close the opening at an upper portion in a liquid tight manner as shown in FIG. 3. The motor 70 is connected to a pump 200 a drive shaft 71 of which is arranged in the tank chamber 182 and is rotabably driven to thereby drive the pump 200 to be rotated.

Figure 4:
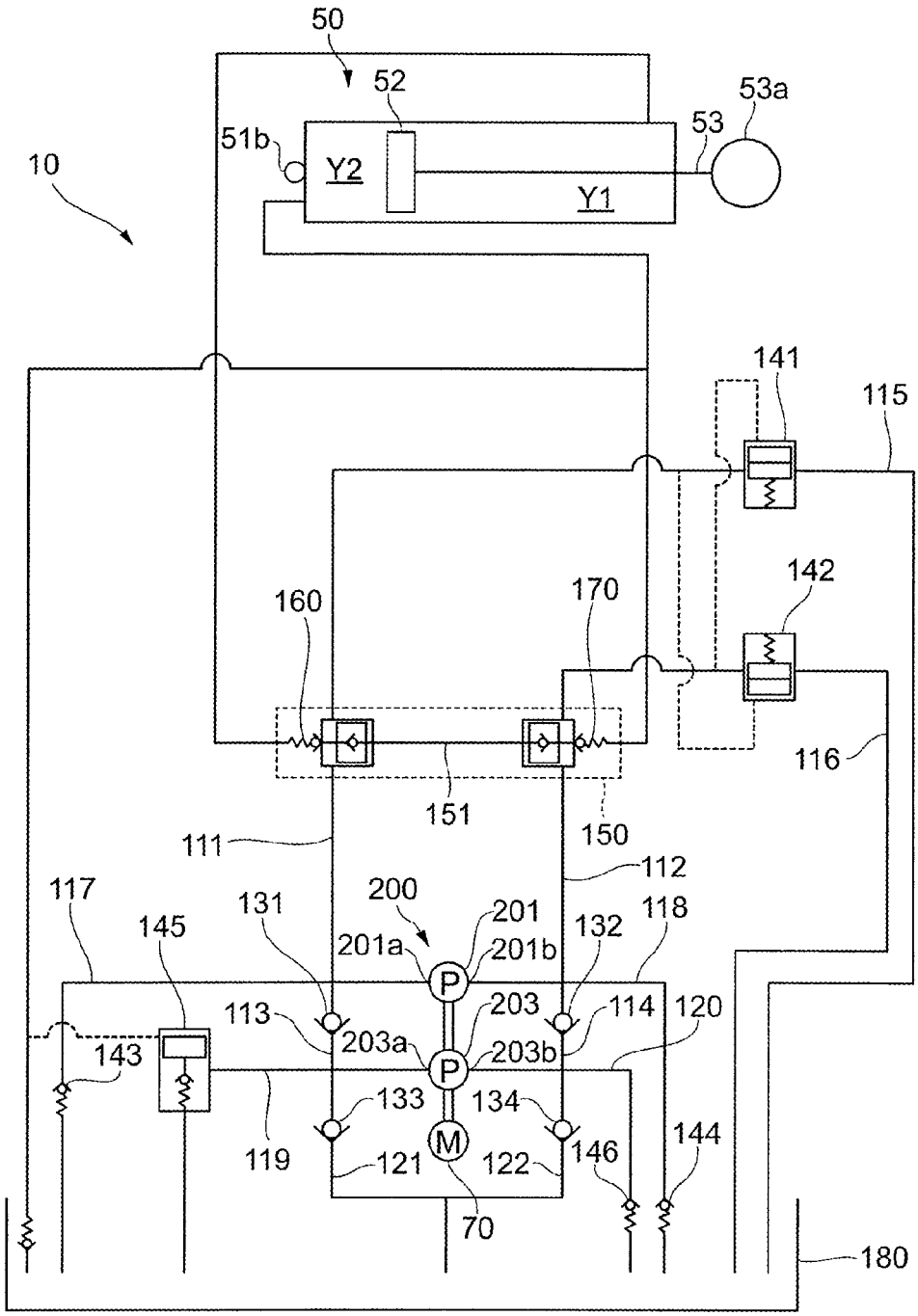
FIG. 4 is a hydraulic circuit of a pump device.

FIG. 4 is a hydraulic circuit of the pump device 10.

(Pump 200)

The pump 200 includes a first pump 201 having a first discharge portion 201*a* and a second discharge portion 201*b* which respectively discharge the oil reserved in the tank 180 and a second pump 203 having a third discharge portion 203*a* and a fourth discharge portion 203*b* which respectively discharge the oil as shown in FIG. 4.

The pump 200 discharges oil from the first discharge portion 201*a* of the first pump 201 and the third discharge portion 203*a* of the second pump 203 when the motor 70 is normally rotated. On the other hand, the pump 200 discharges oil from the second discharge portion 201*b* of the first pump 201 and the fourth discharge portion 203*b* of the second pump 203 when the motor 70 is reversely rotated.

(Arrangement of Flow Path, Valve of Pump Device 10)

As shown in FIG. 4, the pump device 10 includes the first flow path 111 connecting the first chamber Y1 of the cylinder device 50 to the first discharge portion 201*a* of the first pump 201 and the second flow path 112 connecting the second chamber Y2 of the cylinder device 50 to the second discharge portion 201*b* of the first pump 201.

The pump device 10 also includes a third flow path 113 connecting the first chamber Y1 of the cylinder device 50 to the third discharge portion 203*a* of the second pump 203 and a fourth flow path 114 connecting the second chamber Y2 of the cylinder device 50 to the fourth discharge portion 203*b* of the second pump 203.

In the shown example, the third flow path 113 is connected to the first chamber Y1 of the cylinder device 50 through the first flow path 111, and the fourth flow path 114 is connected to the second chamber Y2 of the cylinder device 50 through the second flow path 112.

The pump device 10 also includes a first check valve 131 provided in the third flow path 113 and allowing the flow of oil from the third discharge portion 203*a* of the second pump 203 to the first flow path 111 as well as preventing the flow from the first flow path 111 to the third discharge portion 203*a*.

The pump device 10 further includes a second check valve 132 provided in the fourth flow path 114 and allowing the flow of oil from the fourth discharge portion 203*b* of the second pump 203 to the second flow path 112 as well as preventing the flow of oil from the second flow path 112 to the fourth discharge portion 203*b*.

The pump device 10 includes a first suction path 121 connecting the third flow path 113 to the tank 180 and circulates the oil reserved in the tank 180 to the third discharge portion 203*a*.

The pump device 10 also includes a second suction path 122 connecting the fourth flow path 114 to the tank 180 and circulates the oil reserved in the tank 180 to the fourth discharge portion 203*b*.

The pump device 10 further includes a third check valve 133 provided in the first suction path 121 and allowing the flow of oil from the tank 180 to the third discharge portion 203*a* of the second pump 203 as well as preventing the flow from the third discharge portion 203*a* to the tank 180.

The pump device 10 also includes a fourth check valve 134 provided in the second suction path 122 and allowing the flow of oil from the tank 180 to the fourth discharge portion 203*b* of the second pump 203 as well as preventing the flow from the fourth discharge portion 203*b* to the tank 180.

Furthermore, the pump device 10 includes a fifth flow path 115 branched from the first flow path 111 and connected to the tank 180 and a fifth flow path opening/closing valve 141 provided in the fifth flow path 115 and opening the fifth flow path 115 by receiving a pressure of a later-described sixth flow path 116.

The pump device 10 also includes a sixth flow path 116 branched from the second flow path 112 and connected to the tank 180 and a sixth flow path opening/closing valve 142 provided in the sixth flow path 116 and opening the sixth flow path 116 by receiving a pressure of the fifth flow path 115.

The pump device 10 further includes a seventh flow path 117 branched from the first flow path 111 and connected to the tank 180 and an eighth flow path 118 branched from the second flow path 112 and connected to the tank 180.

The pump device 10 includes a seventh flow path opening/closing valve 143 provided in the seventh flow path 117, which opens when a pressure of the oil in the seventh flow path 117 is higher than a seventh given pressure which is previously set and releases the oil in the first flow path 111 to the tank through the seventh flow path 117.

The pump device 10 further includes an eighth flow path opening/closing valve 144 provided in the eighth flow path 118, which opens when a pressure of the oil in the eighth flow path 118 is higher than an eighth given pressure which is previously set and releases the oil in the second flow path 112 to the tank through the eighth flow path 118.

Furthermore, the pump device 10 includes a ninth flow path 119 branched from the third flow path 113 and connected to the tank 180 and a ninth flow path opening/closing valve 145 provided in the ninth flow path 119 and opening the ninth flow path 119 by receiving a pressure of the second flow path 112.

The pump device 10 also includes a tenth flow path 120 branched from the fourth flow path 114 and connected to the tank 180 and a tenth flow path opening/closing valve 146 provided in the tenth flow path 120, which opens when a pressure of the oil in the tenth flow path 120 is higher than a tenth given pressure which is previously set and releases the oil in the tenth flow path 120 to the tank 180.

The pump device 10 includes a switching valve 150 connected to the first flow path 111 and the second flow path 112 to switch between discharge and return of oil.

The switching valve 150 includes a first opening/closing valve 160 provided on the first flow path 111 and a second opening/closing valve 170 provided on the second flow path 112.

Also in the switching valve 150, a communication path 151 communicating the first opening/closing valve 160 to the second opening/closing valve 170 is formed.

(Pump 200)

Figure 5:
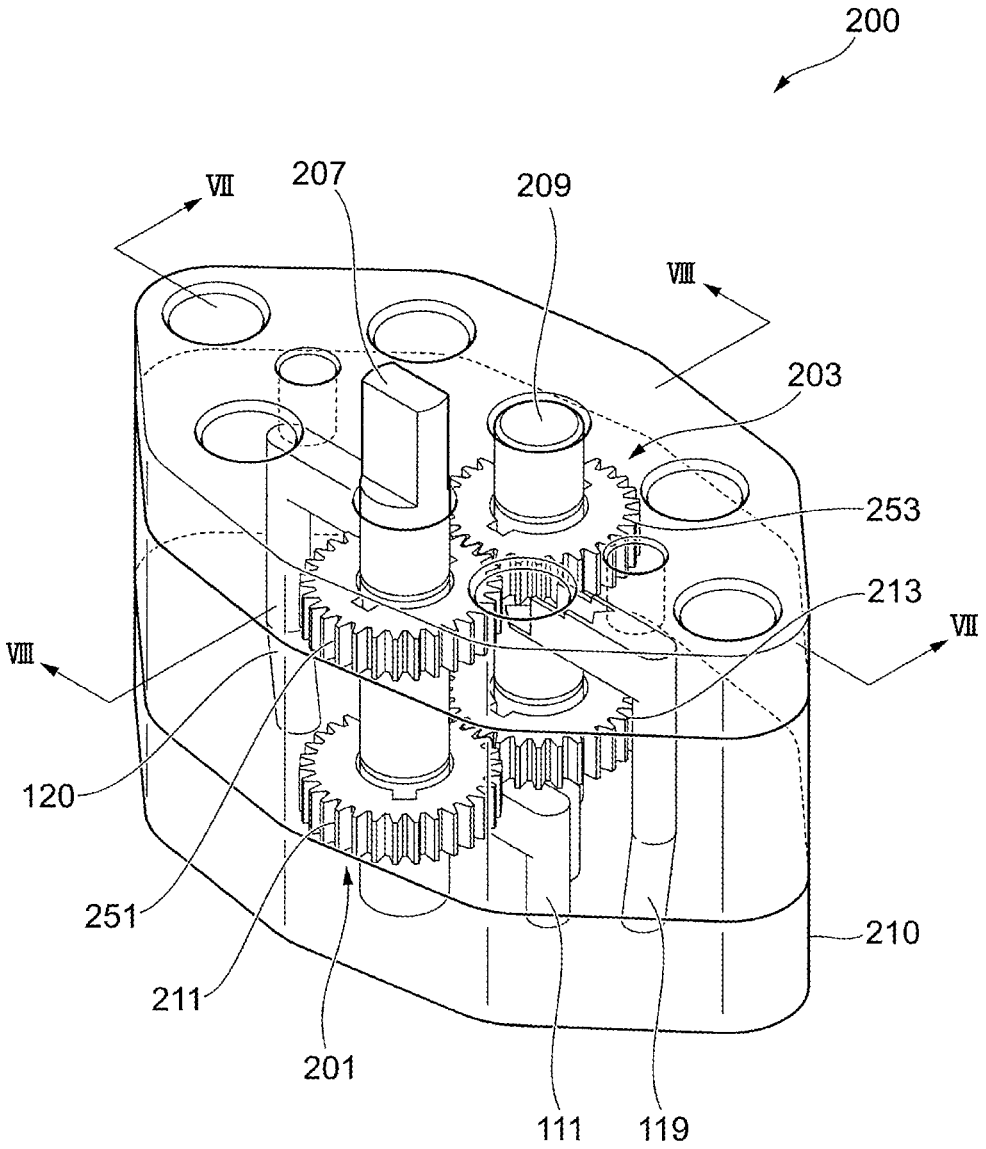
FIG. 5 is a view showing an appearance of a pump.

FIG. 5 is a view showing an appearance of the pump 200.

Figure 6:
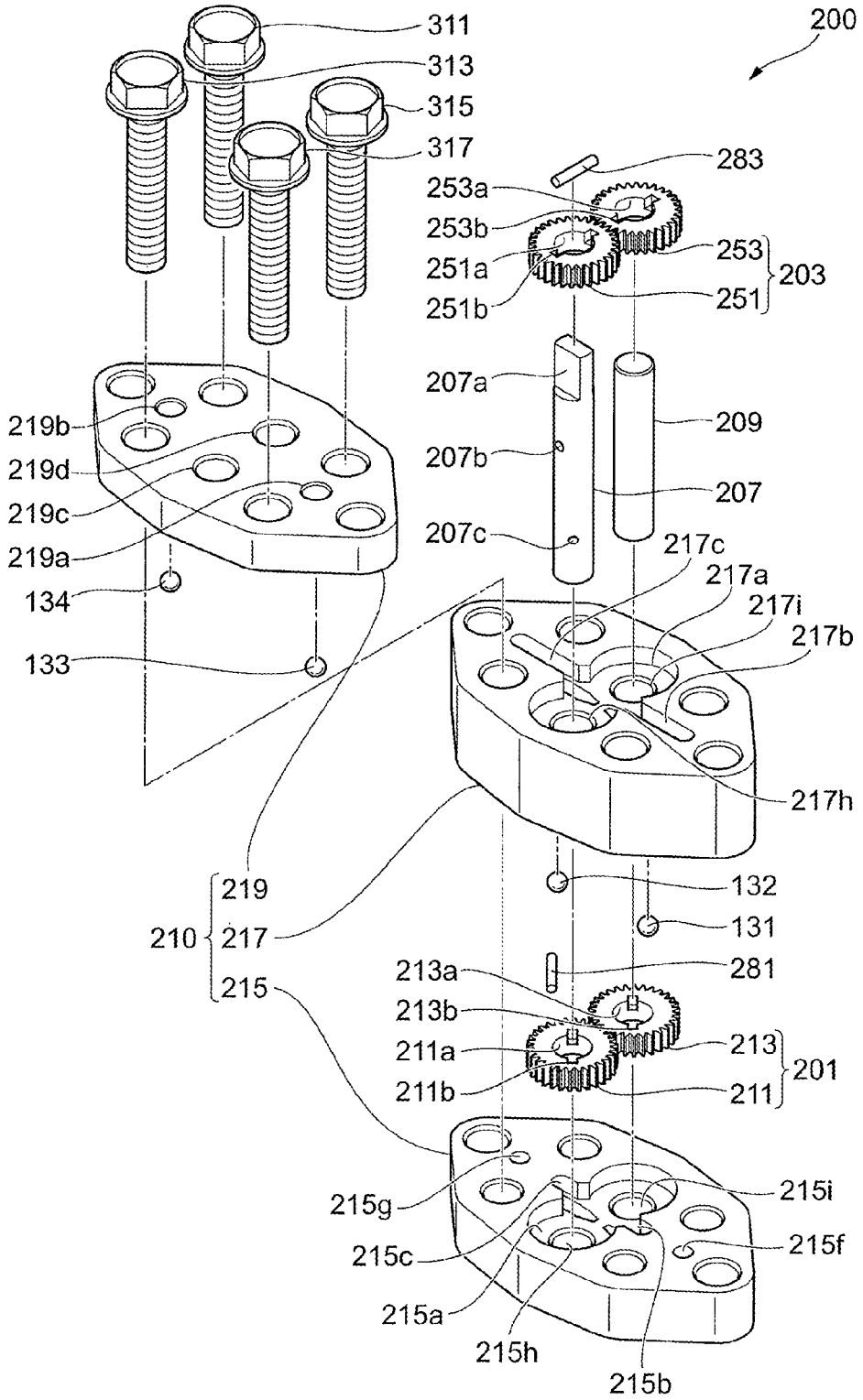
FIG. 6 is an exploded perspective view of the pump.

FIG. 6 is an exploded perspective view of the pump 200.

The pump 200 includes a pump casing 210, the first pump 201 having a first driving gear 211 and a first driven gear 213, and the second pump 203 having a second driving gear 251 and a second driven gear 253.

The pump 200 includes a drive shaft 207 driving the first driving gear 211 and the second driving gear 251 and a support pin 209 supporting the first driven gear 213 and the second driven gear 253.

The pump 200 further includes a first fixing piece 281 and a second fixing piece 283 (see FIG. 6) which fix the first driving gear 211 and the second driving gear 251 respectively with respect to the drive shaft 207, and the above-described first check valve 131 to the fourth check valve 134 (see FIG. 6).

(Pump Casing 210)

Figure 7:
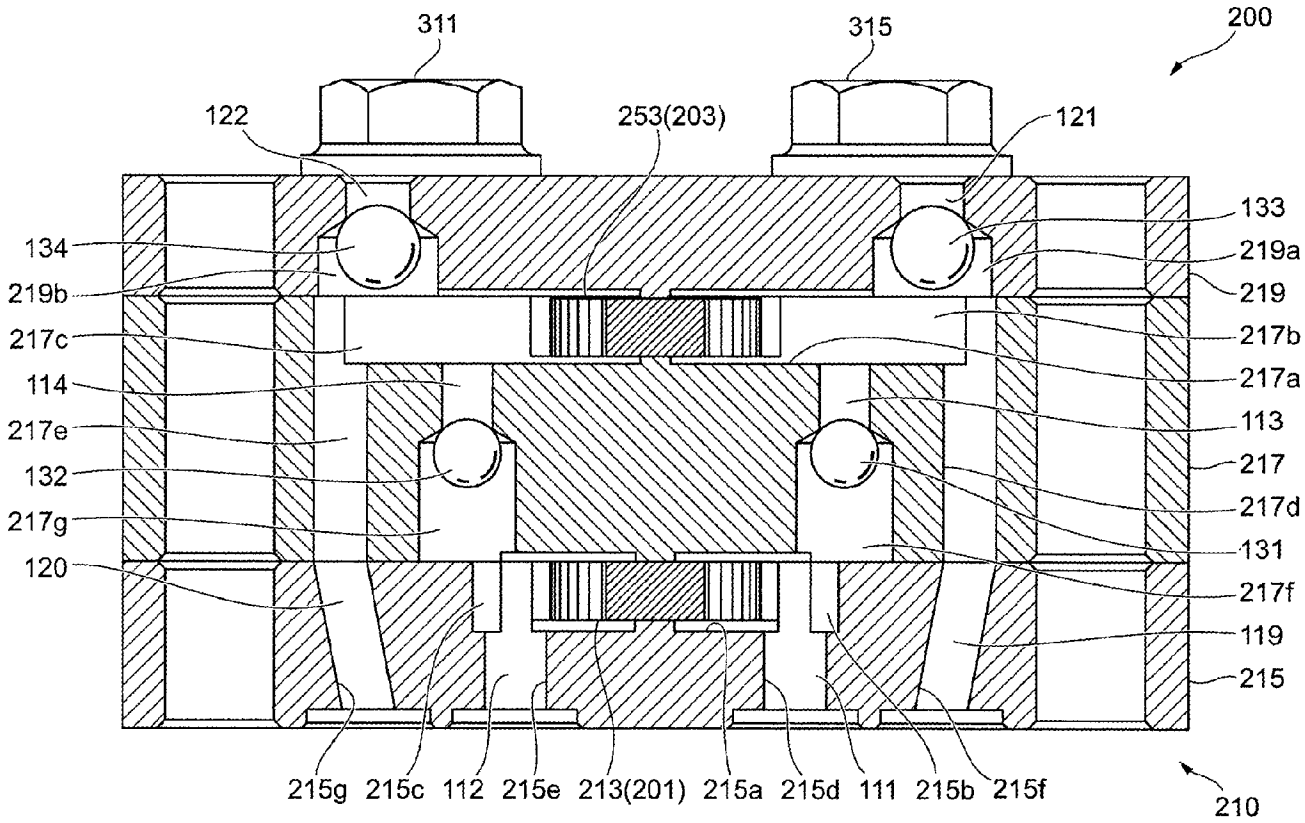
FIG. 7 is a cross-sectional view taken along VII-VII of FIG. 5.

FIG. 7 is a cross-sectional view taken along VII-VII of FIG. 5.

Next, the pump casing 210 will be explained with reference to FIG. 6 and FIG. 7.

As shown in FIG. 6, the pump casing 210 as an example of the casing has a so-called three body structure in which a first casing 215, a second casing 217 and a third casing 219 are stacked in this order from the lower side toward the upper side of the drawing. The shown pump casing 210 is fixed to the housing 181 (see FIG. 2) by not-shown bolts.

In the first casing 215, a first pump chamber 215*a* housing the first pump 201, a first groove 215*b* continued to the first pump chamber 215*a* and a second groove 215*c* continued to the first pump chamber 215*a* in a position opposite to the first groove 215*b* are formed. The first groove 215*b* forms part of the first flow path 111 and the second groove 215*c* forms part of the second flow path 112 as shown in FIG. 7.

Also in the first casing 215, a first through hole 215*d* forming part of the first flow path 111, a second through hole 215*e* forming part of the second flow path 112, a third through hole 215*f* forming part of the ninth flow path 119 and a fourth through hole 215*g* forming part of the tenth flow path 120 are formed as shown in FIG. 7. These first through holes 215*d* to the fourth through hole 215*g* are formed so as to penetrate the first casing 215 in the thickness direction.

Moreover, a first support hole 215*h* into which the drive shaft 207 is inserted and a second support hole 215*i* into which the support pin 209 is inserted are formed in the first casing 215 as shown in FIG. 6. The first support hole 215*h* and the second support hole 215*i* are formed so as to penetrate the first casing 215 in the thickness direction.

In the second casing 217, a second pump chamber 217*a* housing the second pump 203, a third groove 217*b* continued to the second pump chamber 217*a* and a fourth groove 217*c* continued to the second pump chamber 217*a* in a position opposite to the third groove 217*b* are formed. The third groove 217*b* forms part of the ninth flow path 119 and the fourth groove 217*c* forms part of the tenth flow path 120 as shown in FIG. 7.

In the second casing 217, a fifth through hole 217*d* forming part of the ninth flow path 119, a sixth through hole 217*e* forming part of the tenth flow path 120, a first check valve chamber 217*f* forming part of the third flow path 113 and housing the first check valve 131 and a second check valve chamber 217*g* forming part of the fourth flow path 114 and housing the second check valve 132 are formed as shown in FIG. 7. The fifth through hole 217*d*, the sixth through hole 217*e*, the first check valve chamber 217*f* and the second check valve chamber 217*g* are formed so as to penetrate the second casing 217 in the thickness direction.

Also in the second casing 217, a third support hole 217*h* into which the drive shaft 207 is inserted and a fourth support hole 217*i* into which the support pin 209 is inserted are formed as shown in FIG. 6. The third support hole 217*h* and the fourth support hole 217*i* are formed so as to penetrate the second casing 217 in the thickness direction.

In the third casing 219, a third check valve chamber 219*a* forming part of the first suction path 121 and housing the third check valve 133 and a fourth check valve chamber 219*b* forming part of the second suction path 122 and housing the fourth check valve 134 are formed as shown in FIG. 7. The third check valve chamber 219*a* and the fourth check valve chamber 219*b* are formed so as to penetrate the third casing 219 in the thickness direction.

Also in the third casing 219, a fifth support hole 219*c* into which the drive shaft 207 is inserted and a sixth support hole 219*d* into which the support pin 209 is inserted are formed as shown in FIG. 6. The fifth support hole 219*c* and the sixth support hole 219*d* are formed so as to penetrate the third casing 219 in the thickness direction.

(First Pump 201 and Second Pump 203)

Next, the first pump 201 and the second pump 203 will be explained with reference to FIG. 6.

As described above, the first pump 201 includes the first driving gear 211 and the first driven gear 213. The second pump 203 includes the second driving gear 251 and the second driven gear 253. The first pump 201 is an example of a first gear pair and the second pump 203 is an example of a second gear pair.

The first driving gear 211, the first driven gear 213, the second driving gear 251 and the second driven gear 253 have shapes which correspond to one another (are the same). That is, the first driving gear 211, the first driven gear 213, the second driving gear 251 and the second driven gear 253 can be used in common as gears having the single structure.

The above will be explained respectively. First, the first driving gear 211 and the second driving gear 251 have through holes 211*a* and 251*a* into which the drive shaft 207 is inserted, and fixing grooves 211*b* and 251*b* formed on respective one-side surfaces of the first driving gear 211 and the second driving gear 251 and extending in the radial direction. In the shown example, the fixing grooves 211*b* and 251*b* extend so as to cross the through holes 211*a* and 251*a* in the radial direction.

Moreover, the first driven gear 213 and the second driven gear 253 have through holes 213*a* and 253*a* into which the support pin 209 is inserted, and fixing grooves 213*b* and 253*b* formed on respective one-side surfaces of the first driven gear 213 and the second driven gear 253 and extending in the radial direction. In the shown example, the fixing grooves 213*b* and 253*b* as examples of the grooves extend so as to cross the through holes 213*a* and 253*a* in the radial direction.

Here, the first driving gear 211, the first driven gear 213, the second driving gear 251 and the second driven gear 253 have the same number of teeth, and shapes of the teeth correspond to one another. The first driving gear 211, the first driven gear 213, the second driving gear 251 and the second driven gear 253 are made of metal, resin and so on having high abrasion resistance, and for example, made of sintered metal.

(Drive Shaft 207)

Next, the drive shaft 207 will be explained with reference to FIG. 6.

The drive shaft 207 as an example of the shaft is an approximately cylindrical member. The drive shaft 207 includes a flat surface 207*a* formed in an outer peripheral surface at an end portion in the axial direction and connected to the motor 70 (see FIG. 2) and shaft holes 207*b* and 207*c* penetrating the drive shaft 207 in the radial direction.

A length of the drive shaft 207 corresponds to a length in which the shaft extends over the first casing 215, the second casing 217 and the third casing 219 as well as the flat surface 207*a* protrudes from the pump casing 210 when arranged so as to penetrate the pump casing 210. An outer diameter of the drive shaft 207 is set to a dimension allowing insertion into the through hole 211*a* of the first driving gear 211 and the through hole 251*a* of the second driving gear 251.

Here, the shaft holes 207*b* and 207*c* are formed in different positions from each other in the axial direction of the drive shaft 207. The shaft holes 207*b* and 207*c* open to different directions from each other. Specifically, the shaft holes 207*b* and 207*c* have different angles with respect to the central axis, that is, they are 45 degrees shifted on a surface perpendicular to the central axis of the drive shaft 207 in the shown example.

(Support Pin 209)

Next, the support pin 209 will be explained with reference to FIG. 6.

The support pin 209 is an approximately cylindrical member.

A length of the support pin 209 corresponds to a length in which the pin extends over the first casing 215, the second casing 217 and the third casing 219 when arranged so as to penetrate the pump casing 210. In more detail, the support pin 209 has a length in which the pin can be housed in the pump casing 210 when arranged so as to penetrate the pump casing 210 in the shown example.

An outer diameter of the support pin 209 is set to a dimension allowing insertion into the through hole 213*a* of the first driven gear 213 and the through hole 253*a* of the second driven gear 253. In the shown example, the outer diameter of the support pin 209 is smaller than the outer diameter of the drive shaft 207.

The shaft hole 207*b* and 207*c* are not formed in the shown support pin 209, which differs from the drive shaft 207.

(First Fixing Piece 281 and Second Fixing Piece 283)

Next, the first fixing piece 281 and the second fixing piece 283 will be explained with reference to FIG. 6.

The first fixing piece 281 and the second fixing piece 283 are long members, having an approximately cylindrical shape in the shown example. The first fixing piece 281 and the second fixing piece 283 have dimensions allowing insertion into the shaft holes 207*b* and 207*c* of the drive shaft 207. The first fixing piece 281 and the second fixing piece 283 have lengths in which the pieces penetrate the drive shaft 207 and both ends protrude from the drive shaft 207 as well as pieces are housed in the fixing grooves 211*b* and 251*b* in a state of being inserted into the shaft holes 207*b* and 207*c*.

(Arrangement and Operation of Respective Components)

Figure 8:
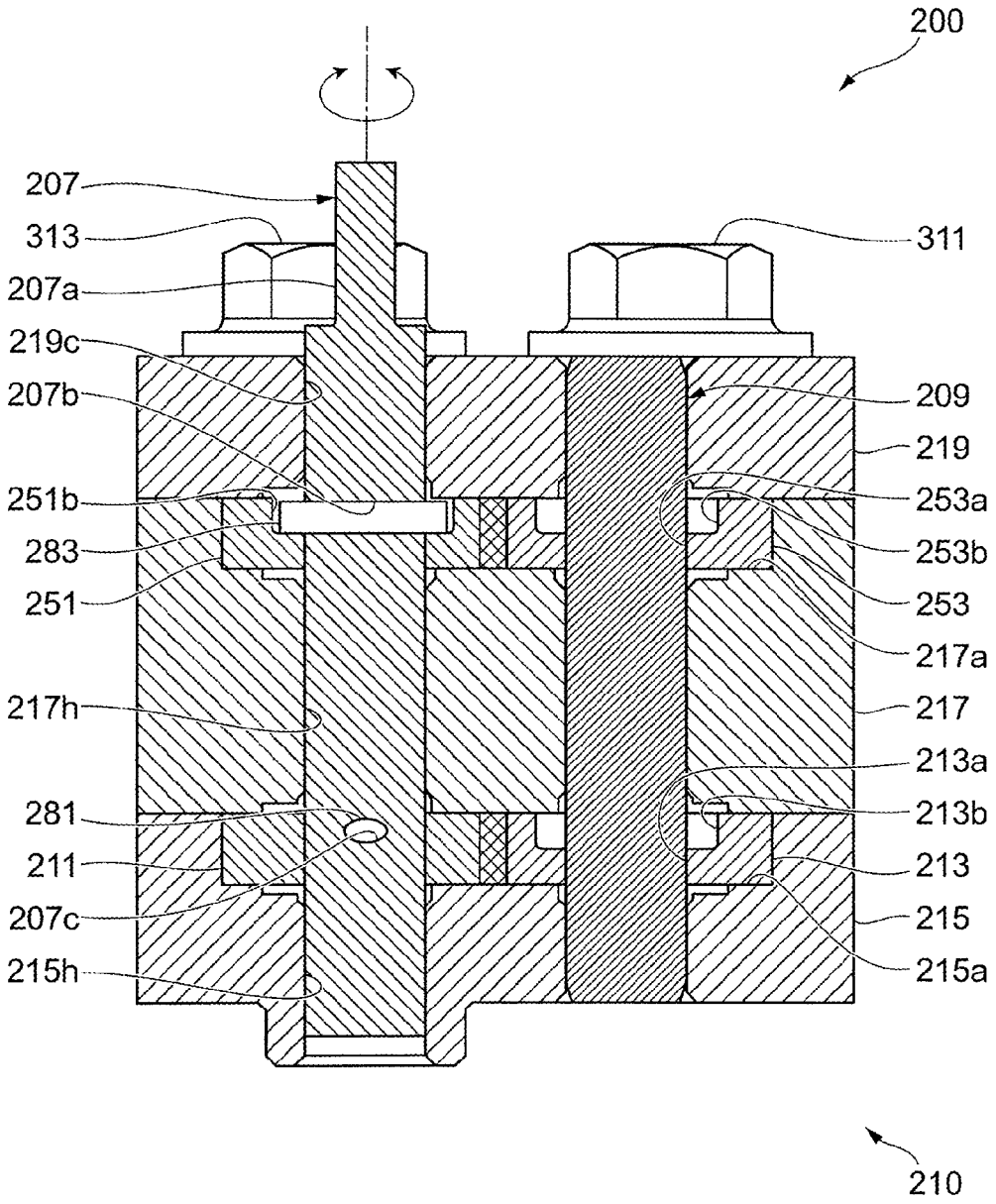
FIG. 8 is a cross-sectional view taken along VIII-VIII of FIG. 5.

FIG. 8 is a cross-sectional view taken along VIII-VIII of FIG. 5.

Next, the arrangement and the operation of respective components in the assembled pump 200 will be explained with reference to FIG. 6 to FIG. 8.

First, the arrangement and the operation of the drive shaft 207 will be explained.

The drive shaft 207 is provided so as to penetrate the pump casing 210. The drive shaft 207 is rotatably supported by the first casing 215, the second casing 217 and the third casing 219. The flat surface 207*a* of the drive shaft 207 protrudes from the first casing 215 and connected to the motor 70 (see FIG. 2).

The drive shaft 207 penetrates the first driving gear 211 and the second driving gear 251. In other words, the first driving gear 211 and the second driving gear 251 are coaxially arranged.

Moreover, the first fixing piece 281 and the second fixing piece 283 are provided so as to penetrate the shaft holes 207*b* and 207*c* of the drive shaft 207. The first fixing piece 281 and the second fixing piece 283 inserted into the shaft holes 207*b* and 207*c* protrude from an outer peripheral surface of the drive shaft 207 and are arranged inside the fixing groove 211*b* of the first driving gear 211 and the fixing groove 251*b* of the second driving gear 251. The first fixing piece 281 and the second fixing piece 283 suppress displacement of relative positions between the first driving gear 211/the second driving gear 251 and the drive shaft 207.

According to the above arrangement, when the drive shaft 207 receiving the driving of the motor 70 rotates, the first driving gear 211 and the second driving gear 251 rotate with the drive shaft 207.

Next, the arrangement of the operation of the support pin 209 will be explained.

The support pin 209 is provided so as to penetrate the pump casing 210. The support pin 209 is fixed by the first casing 215, the second casing 217 and the third casing 219. That is, the support pin 209 is supported by the pump casing 210 and the movement of the support pin 209 in a circumferential direction and in an axial direction is restricted. In more detail, the support pin 209 is in a state of being fitted into the first casing 215, the second casing 217 and the third casing 219 respectively, more specifically, the support pin 209 is press-fitted to the casings.

The support pin 209 penetrates the first driven gear 213 and the second driven gear 253. In other words, the first driven gear 213 and the second driven gear 253 are coaxially arranged. The first driven gear 213 and the second driven gear 253 can rotate around the outer periphery of the support pin 209. Moreover, the first driven gear 213 and the second driven gear 253 are arranged so as to be engaged with the first driving gear 211 and the second driven gear 251.

According to the above arrangement, when the first driving gear 211 and the second driving gear 251 receiving the driving of the motor 70 rotate, the first driven gear 213 and the second driven gear 253 rotate around the outer periphery of the support pin 209. Additionally, the first driven gear 213 and the second driven gear 253 do not rotate with the support pin 209 and rotate around the outer periphery of the fixed support pin 209, which differs from the drive shaft 207.

Incidentally, the fixing grooves 213*b* and 253*b* are formed in the first driven gear 213 and the second driven gear 253 as described above. The fixing grooves 213*b* and 253*b* function as oil reservoirs by allowing oil to enter into the respective grooves.

Specifically, oil enters into the fixing groove 213*b* in the first driven gear 213. The oil enters between an inner peripheral surface of the through hole 213*a* of the first driven gear 213 and an outer peripheral surface of the support pin 209. On the other hand, the oil inside the fixing groove 253*b* enters between an inner peripheral surface of the through hole 253*a* of the second driven gear 253 and the outer peripheral surface of the support pin 209 in the second driven gear 253. Accordingly, the sliding property of the first driven gear 213 and the second driven gear 253 which rotate around the outer periphery of the support pin 209 is improved.

The support pin 209 is in a state of being fitted to the first casing 215, the second casing 217 and the third casing 219 respectively as described above. That is, relative positions with respect to the first casing 215, the second casing 217 and the third casing 219 are respectively fixed by the support pin 209.

Accordingly, the support pin 209 can be used as a positioning member in the assembly work of the pump 200. For example, after the support pin 209 is fitted to the first casing 215, the second casing 217 and the third casing 219 are assembled to the support pin 209, thereby suppressing the displacement of relative positions, for example, among the first casing 215, the second casing 217 and the third casing 219.

Note that fastening members 311, 313, 315 and 317 (see FIG. 6) in the shown example fulfill a function of fastening the first casing 215, the second casing 217 and the third casing 219.

Here, the comparison between the embodiment and a case where a structure different from the embodiment is applied will be explained.

That is, when a structure in which the support pin 209 rotates with the first driven gear 213 and the second driven gear 253 is applied, the support pin 209 is rotatably supported by the first casing 215, the second casing 217 and the third casing 219.

In this case, it is necessary to reduce a surface pressure added to the support pin 209 for preventing seizure of the support pin 209. Then, it is necessary to apply structures in which the dimension of the pump 200 is increased by increasing the length of the support pin 209 in the axial direction in portions of the support pin 209 supported by the first casing 215 and so on or by adding a bearing receiving the support pin 209 for reducing the surface pressure.

On the other hand, the embodiment has the structure in which the support pin 209 is fixed to the first casing 215 and so on, therefore, the necessity of applying the structure in which the dimension of the pump 200 is increased as described above is reduced. Additionally, the fixing grooves 213*b* and the 253*b* are formed in the first driven gear 213 and the second driven gear 253 in the embodiment, therefore, lubricating property in the support pin 209 can be secured without using the bearing.

(Flow of Oil)

Figure 9A:
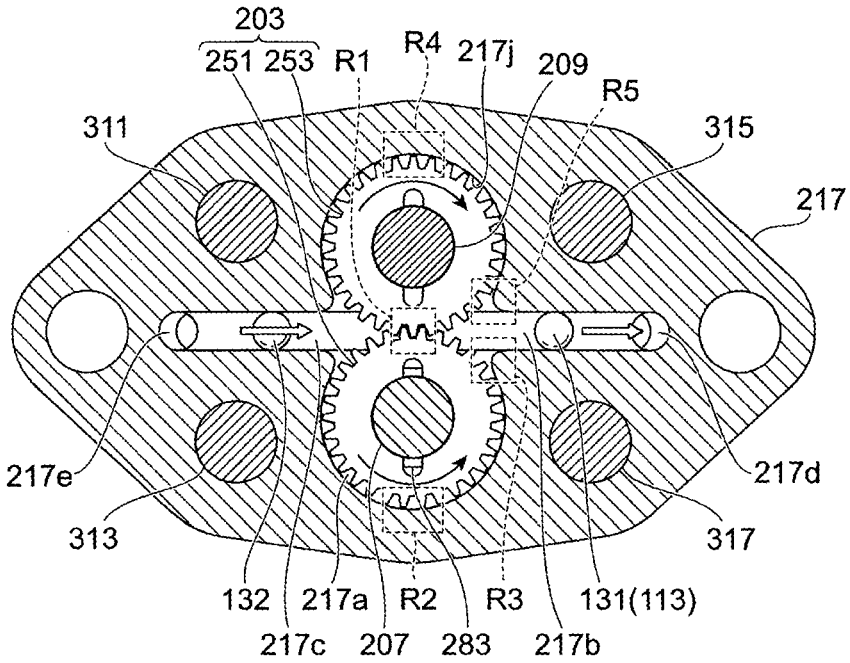
FIGS. 9A and 9B are views for explaining the flow of oil in the pumps.
Figure 9B:
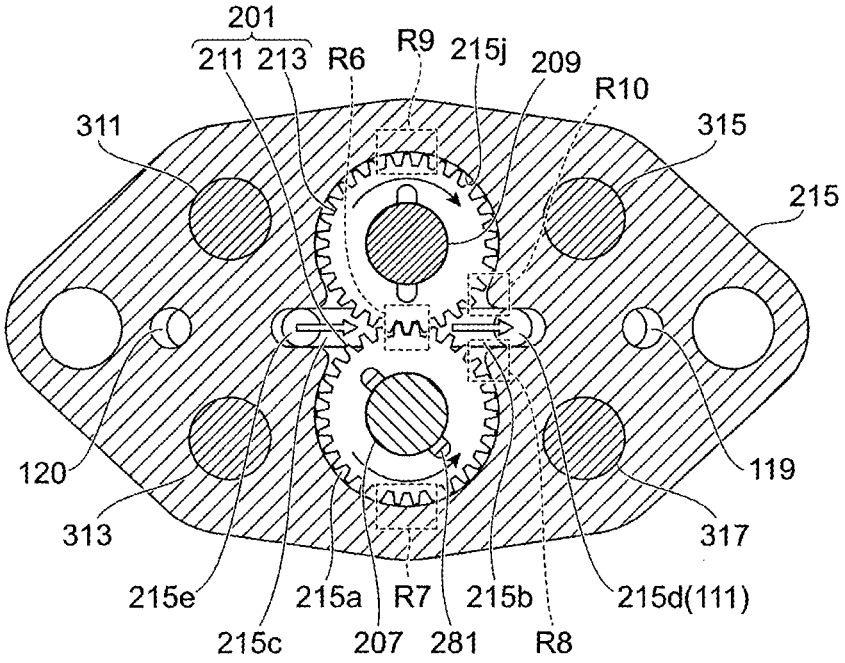

FIGS. 9A and 9B are views for explaining the flow of oil in the pump 200. Specifically, FIG. 9A shows the flow of oil in the second pump 203 and FIG. 9B shows the flow of oil in the first pump 201.

Next, the flow of oil in the pump 200 will be explained with reference to FIGS. 9A and 9B. Here, a case where the drive shaft 207 rotates in the counterclockwise direction in the drawing will be explained in FIGS. 9A and 9B. In more detail, the second driving gear 251 rotates in the counterclockwise direction and the second driven gear 253 rotates in the clockwise direction in FIG. 9A. The first driving gear 211 rotates in the counterclockwise direction and the first driven gear 213 rotates in the clockwise direction in FIG. 9B.

First, the second pump 203 will be explained with reference to FIG. 9A. When the second driving gear 251 and the second driven gear 253 receiving the driving of the drive shaft 207 rotate, the oil flows from the second suction path 122 (see FIG. 4) in a direction of the third flow path 113 (see white arrows in the drawing) through the second pump 203.

Specifically, in the second driving gear 251, the oil flowing in from the second suction path 122 (see FIG. 4) passes a discharge area R3 where the oil is discharged to the third groove 217*b* (third flow path 113) from a shutting area R1 where the second driving gear 251 is engaged with the second driven gear 253 and the oil is shut through an outer side area R2 positioned opposite to the shutting area R1 with the drive shaft 207 interposed therebetween. Additionally, the discharge area R3 is a place where the oil sealed between the second driving gear 251 and an inner peripheral surface 217*j* of the second pump chamber 217*a* is released as the second driving gear 251 rotates.

Similarly, in the second driven gear 253, the oil flowing in from the fourth flow path 114 (see FIG. 4) passes a discharge area R5 where the oil is discharged to the third groove 217*b* (third flow path 113) from the shutting area R1 through an outer side area R4 positioned opposite to the shutting area R1 with the support pin 209 interposed therebetween. Additionally, the discharge area R5 is a place where the oil sealed between the second driven gear 253 and the inner peripheral surface 217*j* of the second pump chamber 217*a* is released as the second driving gear 253 rotates.

Furthermore, the oil carried by the second driving gear 251 and the second driven gear 253 joins the third groove 217*b* (third flow path 113) as an example of the flow path in the discharge areas R3 and R5.

Next, the first pump 201 will be explained with reference to FIG. 9. When the first driving gear 211 and the first driven gear 213 rotate by receiving the driving of the drive shaft 207, the oil flows from the fourth flow path 114 (see FIG. 4) in a direction of the first flow path 111 (see white arrows in the drawing) through the first pump 201.

In the periphery of the first driving gear 211, the oil passes a discharge area R8 from a shutting area R6 through an outer side area R7, though the detailed explanation is omitted as it is the same as in the above second pump 203. In the periphery of the first driven gear 213, the oil passes a discharge area R10 from the shutting area R6 through the outer side area R9.

The discharge area R8 is a place where the oil sealed between the first driving gear 211 and an inner peripheral surface 215*j* of the first pump chamber 215*a* is released as the first driving gear 211 rotates. The discharge area R10 is a place where the oil sealed between the first driven gear 213 and the inner peripheral surface 215*j* of the first pump chamber 215*a* is released as the first driven gear 213 rotates.

Additionally, the oil carried by the first driving gear 211 and the first driven gear 213 joins the first groove 215*b* (first flow path 111) in the discharge areas R8 and R10. The oils respectively carried by the first driving gear 211/the first driven gear 213 as well as the second driving gear 251/the second driven gear 253 join in the first groove 215*b* (first flow path 111).

(Sound of First Pump 201 and Second Pump 203)

Figure 10:
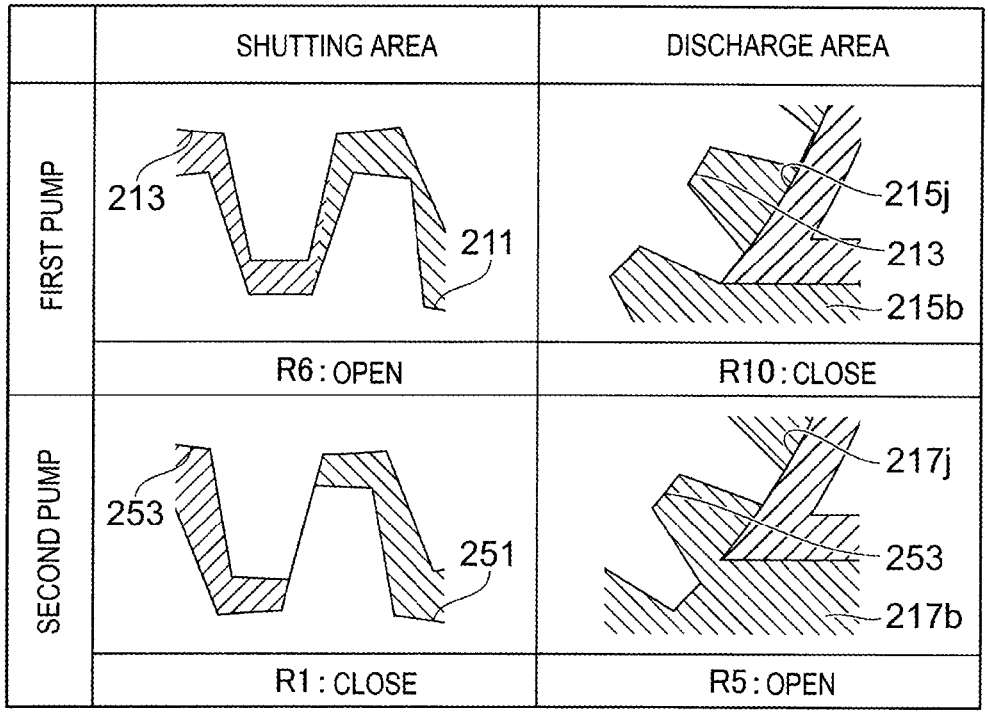
FIG. 10 is a table for explaining phases of a first pump and a second pump.

FIG. 10 is a table for explaining phases of the first pump 201 and the second pump 202.

Figure 11:
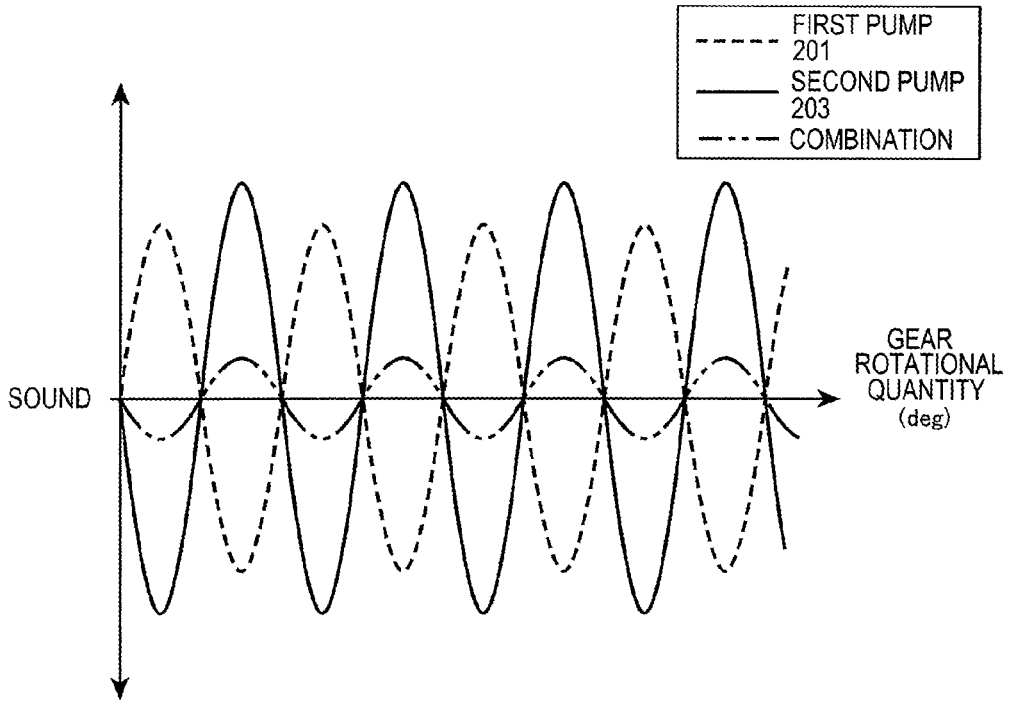
FIG. 11 is a view for explaining sounds generated by the rotation of the first pump and the second pump.

FIG. 11 is a view for explaining sounds generated by the rotation of the first pump 201 and the second pump 203. In more detail, the horizontal axis in FIG. 11 indicates the rotational quantity of gears in the first pump 201 and the second pump 203 and the vertical axis indicates the volume of sounds to be generated.

Next, the sounds generated by driving the first pump 201 and the second pump 203 will be explained with reference to FIG. 10 and FIG. 11.

First, when the first pump 201 and the second pump 203 are driven, sounds are generated due to various factors such as discharging pulsation of oil, the shutting of oil by engagement of gears and the sliding of gears. In particular, when plural pumps (the first pump 201 and the second pump 203) are used by using the motor 70 as the same drive source as in the shown example, timings of the discharge pulsation of oil and the shutting of oil can correspond, therefore, sounds may be synchronized and increased.

In response to this, phases of the first pump 201 and the second pump 203 are displaced in the embodiment. In the shown example, angles at which the first driving gear 211 and the second driving gear 251 are fixed with respect to the drive shaft 207 differ from each other. Accordingly, the sounds generated when driving the first pump 201 and the second pump 203 are suppressed.

In more detail, as shown in FIG. 10, the timing when the first driving gear 211 is engaged with the first driven gear 213 and the timing when the second driving gear 251 is engaged with the second driven gear 253 are shifted in the shutting areas R1 and R6. For example, when the first driving gear 211 is not engaged with the first driven gear 213, namely, in the "opened" state in the first pump 201, the second driving gear 251 is engaged with the second driven gear 253, namely, in the "closed" state in the second pump 203.

Also, in the timing when the shutting area R6 of the first pump 201 is in the "closed" state, the shutting area R1 of the second pump 203 is in the "opened" state, though not shown.

On the other hand, the timing when the sealed state by the first driven gear 213 and the inner peripheral surface 215*j* is opened and the timing when the sealed state by the second driven gear 253 and the inner peripheral surface 217*j* is opened are shifted in the discharge areas R5 and R10. In other words, the timing when the oil fed from the first pump 201 joins the first groove 215*b* (the first flow path 111) and the timing when the oil fed from the second pump 203 joins the third groove 217*b* (the ninth flow path 119) are shifted.

For example, as shown in FIG. 10, when the first driven gear 213 and the inner peripheral surface 215*j* are closed in the first pump 201, namely, in the timing of the "closed"

state, the second driven gear 253 and the inner peripheral surface 217*j* are opened in the second pump 203, namely, in the timing of the "opened" state.

Additionally, in the timing when the discharge area R10 of the first pump 201 is in the "opened" state, the discharge area R5 of the second pump 203 is in the "closed" state, though not shown.

Here, the sounds generated by shifting phases of the first pump 201 and the second pump 203 will be explained with reference to FIG. 11. The shown example is a state in which phases of the gear rotational quantity in the first pump 201 and the second pump 203 are shifted by a half cycle of the sounds to be generated.

In the structure in which phases of the first pump 201 and the second pump 203 are shifted as shown in FIG. 11, when sounds generated from the first pump 201 and the second pump 203 are compared with combination (see "combination" in the drawing) of sounds of the first pump 201 and the second pump 203, the maximum volume is smaller in the combined sound. That is, it is found that sounds generated from respective pumps cancel each other by shifting the phase of the first pump 201 and the second pump 203, as a result, the combined sound is suppressed.

(Modification Examples)

In the above explanation, fixing positions of the first driving gear 211 and the second driving gear 251 with respect to the drive shaft 207 are shifted each other by using the first fixing piece 281 and the second fixing piece 283, however, the present invention is not limited to this. For example, a structure in which flat surfaces having different angles are provided at plural positions on the outer peripheral surface of the drive shaft 207 may be applied as long as angles of the first driving gear 211 and the second driving gear 251 are uniquely determined by fitting the first driving gear 211 and the second driving gear 251 to the drive shaft 207.

Also in the above explanation, the support pin 209 is used in the three-layer structure including the first casing 215, the second casing 217 and the third casing 219, however, the present invention is not limited to this. It is naturally preferable that the support pin 209 is used as the positioning member in structures of two layers, four layers or more. It is also preferable that only the support pin 209 is used as the positioning member or that the support pin 209 is used as the positioning member with another positioning member.

Also in the above explanation, the opening/closing timings of the shutting areas R1 and R6 and the opening/closing timings of the discharge areas R5 and R10 are explained. At least one of the opening/closing timings of the shutting areas R1 and R6 and the opening/closing timings of the discharge areas R5 and R10 may be shifted. Moreover, the opening/closing timings of the shutting areas R1, R6 and the opening/closing timings of the discharge areas R5, R10 may correspond each other or may be shifted each other.

Though various embodiments and modification examples have been explained as the above, it is naturally preferable that these embodiments and modification examples may be combined.

The present disclosure is not limited at all to the above configuration examples and can be executed in various forms within a scope not departing from the gist of the present disclosure.

What is claimed is:

1. A pump device comprising:

a shaft;

a first gear pair comprising a first driving gear which is disposed on the shaft and is rotatable together with the shaft, and a first driven gear driven by the first driving gear to feed an operating fluid;

a second gear pair comprising a second driving gear which is disposed on the shaft coaxially with the first driving gear and is rotatable together with the shaft, and a second driven gear driven by the second driving gear and arranged coaxially with the first driven gear to feed an operating fluid;

a support pin penetrating the first driven gear and the second driven gear and rotatably supporting the first driven gear and the second driven gear; and a casing covering the first gear pair and the second gear pair, wherein the support pin is fixed to the casing in such a manner that a movement of the support pin in a circumferential direction is restricted.

2. The pump device according to claim 1, wherein the casing comprises plural casings housing the first gear pair and the second gear pair by sandwiching the first gear pair and the second gear pair, and the support pin is fixed to the plural casings.

3. The pump device according to claim 2, wherein the plural casings comprise a first casing, a second casing and a third casing, the first gear pair is housed by being sandwiched between the first casing and the second casing, the second gear pair is housed by being sandwiched between the second casing and the third casing, and both ends of the support pin are fixed to the first casing and the third casing respectively.

4. The pump device according to claim 1, wherein each of the first driven gear and the second driven gear has an insertion hole into which the support pin is inserted, and at least one of the first driven gear and the second driven gear has, around the insertion hole, a groove continued to the insertion hole.

5. The pump device according to claim 2, wherein each of the first driven gear and the second driven gear has an insertion hole into which the support pin is inserted, and at least one of the first driven gear and the second driven gear has, around the insertion hole, a groove continued to the insertion hole.

6. The pump device according to claim 3, wherein each of the first driven gear and the second driven gear has an insertion hole into which the support pin is inserted, and at least one of the first driven gear and the second driven gear has, around the insertion hole, a groove continued to the insertion hole.

7. The pump device according to claim 1, wherein the first driving gear, the first driven gear, the second driving gear and the second driven gear have same number of teeth.

8. The pump device according to claim 2, wherein the first driving gear, the first driven gear, the second driving gear and the second driven gear have same number of teeth.

9. The pump device according to claim 3, wherein the first driving gear, the first driven gear, the second driving gear and the second driven gear have same number of teeth.

10. The pump device according to claim 4, wherein the first driving gear, the first driven gear, the second driving gear and the second driven gear have same number of teeth.

11. The pump device according to claim 5, wherein the first driving gear, the first driven gear, the second driving gear and the second driven gear have same number of teeth.

12. The pump device according to claim 6, wherein the first driving gear, the first driven gear, the second driving gear and the second driven gear have same number of teeth.

13. A pump device comprising:

a shaft;

a first gear pair comprising a first driving gear which is disposed on the shaft and is rotatable together with the shaft, and a first driven gear driven by the first driving gear and having same number of teeth as the first driving gear to feed an operating fluid;

a second gear pair comprising a second driving gear which is disposed on the shaft coaxially with the first driving gear, is rotatable together with the shaft, and has same number of teeth as the first driving gear, and a second driven gear driven by the second driving gear, arranged coaxially with the first driven gear and having same number of teeth as the first driving gear to feed an operating fluid;

a support pin having a smaller diameter than the shaft, penetrating the first driven gear and the second driven gear and rotatably supporting the first driven gear and the second driven gear; and a casing comprising plural casings which house the first gear pair and the second gear pair by sandwiching the gear pairs, wherein the support pin is fixed to the plural casings in such a manner that a movement of the support pin in a circumferential direction is restricted.

14. The pump device according to claim 13, wherein the plural casings comprise a first casing, a second casing and a third casing, the first gear pair is housed by being sandwiched between the first casing and the second casing, the second gear pair is housed by being sandwiched between the second casing and the third casing, and both ends of the support pin are fixed to the first casing and the third casing respectively.

15. A ship propulsion machine comprising:

a ship propulsion machine body having a propeller; and a tilt/trim device comprising a cylinder device having a cylinder, a piston partitioning an inside of the cylinder into a first chamber and a second chamber and a piston rod an end portion of which is fixed to the piston and which is extended from the cylinder, and a pump device configured to extend and retract the cylinder device by supplying an operating fluid into the cylinder device, wherein the pump device comprises: a shaft; a first gear pair comprising a first driving gear which is disposed on the shaft and is rotatable together with the shaft, and a first driven gear driven by the first driving gear to feed an operating fluid; a second gear pair comprising a second driving gear which is disposed on the shaft coaxially with the first driving gear and is rotatable together with the shaft, and a second driven gear driven by the second driving gear and arranged coaxially with the first driven gear to feed an operating fluid; a support pin penetrating the first driven gear and the second driven gear and rotatably supporting the first driven gear and the second driven gear; and a casing covering the first gear pair and the second gear pair, in which the support pin is fixed to the casing in such a manner that a movement of the support pin in a circumferential direction is restricted.

16. The pump device according to claim 1, wherein the the support pin is press-fitted to the casing to be fixed.

17. The pump device according to claim 13, wherein the the support pin is press-fitted to the plural casings to be fixed.

18. The pump device according to claim 1, wherein the casing comprises a first casing, a second casing and a third casing, and the first casing, the second casing and the third casing are fixed by the support pin.

* * * * *